US008387935B2

(12) United States Patent
Khan et al.

(10) Patent No.: US 8,387,935 B2
(45) Date of Patent: Mar. 5, 2013

(54) TWO-IN-ONE BLOWER AND ELECTRICAL CONTROLS BRACKET

(75) Inventors: Tabraiz Ali Khan, Wichita, KS (US); Robert Cabrera, Wichita, KS (US); Bennie Dale Hoyt, Benton, KS (US)

(73) Assignee: Johnson Controls Technology Company, Holland, MI (US)

( * ) Notice: Subject to any disclaimer, the term of this patent is extended or adjusted under 35 U.S.C. 154(b) by 1125 days.

(21) Appl. No.: 11/971,514

(22) Filed: Jan. 9, 2008

(65) Prior Publication Data

US 2008/0164388 A1 Jul. 10, 2008

Related U.S. Application Data

(60) Provisional application No. 60/884,261, filed on Jan. 10, 2007.

(51) Int. Cl.
*E04G 3/00* (2006.01)

(52) U.S. Cl. ..... 248/274.1; 248/298.1

(58) Field of Classification Search ..... 248/274.1, 248/298.1

See application file for complete search history.

(56) References Cited

U.S. PATENT DOCUMENTS 6,318,103 B1 * 11/2001 Rieger et al. ..... 62/259.2
2005/0194003 A1 * 9/2005 Paulsen et al. ..... 126/110 R

* cited by examiner

*Primary Examiner* — Cheryl J Tyler
*Assistant Examiner* — Jonathan Koagel
(74) *Attorney, Agent, or Firm* — McNees Wallace & Nurick LLC

(57) ABSTRACT

A furnace system is provided having a blower bracket arrangement. The blower bracket arrangement is configured to mount both a blower and electrical controls for the furnace. The bracket supports the blower for the HVAC system and provides an easy mode for moving the blower in and out of the HVAC system for maintenance and repairs. The electrical controls are easily accessible when mounted to the blower bracket arrangement.

15 Claims, 4 Drawing Sheets

TWO-IN-ONE BLOWER AND ELECTRICAL CONTROLS BRACKET

CROSS REFERENCE TO RELATED PATENT APPLICATIONS

This application claims the benefit of U.S. Provisional Application No. 60/884,261, filed Jan. 10, 2007.

BACKGROUND

The present application relates generally to bracketing arrangements for a furnace system and more specifically to a two in one blower bracket arrangement and electrical controls bracket for a furnace or HVAC system.

The basic components of a furnace or HVAC system are: a burner, a heat exchanger, an air distribution system, and a vent pipe. In the burner, gas (natural or propane) or oil is delivered and burned to generate heat. The heat exchanger transfers the heat from the burning gas to the air distribution system. The air distribution system, which includes a blower and ductwork, delivers the heated air throughout the home and returns cooler air to the furnace to be heated. Finally, the vent pipe or flue exhausts byproducts of combustion (such as water vapor and carbon dioxide) outside of the home. In addition, the furnace system may also include a cooling element, such as an A-coil, that operates in conjunction with an air conditioning unit (typically located outside of the home) to provide cooled air to the home instead of heated air.

Typically, furnace systems in residential applications are located in the basement or a small closet in the user's home, which areas have limited space for an installed furnace system. Furthermore, efficiency standards have recently changed, thereby requiring the size of the A-coil to be increased to meet these new standards. Thus, when a newer furnace system is needed to replace an older system, often, the newer furnace can not fit into the space where the old furnace was installed because the size of the furnace unit and the newer, taller A-coil that is required is greater than the available installation space. Thus, a shorter, furnace is needed to accommodate the taller A-coil in order to be able to install a new furnace system in the same space as the old furnace system.

Each individual HVAC system has a blower in the air distribution system to push the air through the ductwork. A bracket arrangement for the blower provide support and a mounting means for the blower in the system. What is needed is a bracket that provides easy maintenance and accessibility of the blower while providing a mounting surface for the electrical controls for the system. What is also needed is a bracket arrangement that provides easy access to the electrical controls as well.

Intended advantages of the disclosed systems and/or methods satisfy one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment is directed to a bracket arrangement having a fixed bracket part that is substantially stationary and a movable bracket part that is moveable about the fixed bracket part. At least one of a blower, or a mounting plate with at least one electrical control mounted to it, are mounted to the movable bracket part. Upon the application of a force the blower and/or mounting plate with at least one electrical control are moved to at least one predetermined position along the path of the movable bracket part.

An HVAC&R/bracket arrangement having an HVAC system with a blower, a housing to enclose the HVAC system, a fixed bracket part mounted to the housing and being substantially stationary, and a movable bracket part moveable about the fixed bracket part. The blower is mounted to the movable bracket part, and upon the application of a force, the blower is moved to at least one predetermined position along the path of the movable bracket part.

An advantage is a single bracket arrangement that provides a bracket for a blower of an HVAC system while providing a mounting surface for the electrical controls of the HVAC system.

Another advantage is the bracket arrangement provides a simple means to push or pull the blower bracket into and out of the HVAC system.

Yet another advantage is that the controls are easily accessible when the bracket and blower are partially pulled out of the HVAC system.

Other features and advantages will be apparent from the following more detailed description of the embodiments, taken in conjunction with the accompanying drawings which illustrate, by way of example, the principles of the application.

BRIEF DESCRIPTION OF THE DRAWINGS

Wherever possible, the same reference numbers will be used throughout the drawings to refer to the same or like parts.

DETAILED DESCRIPTION

Figure 1:
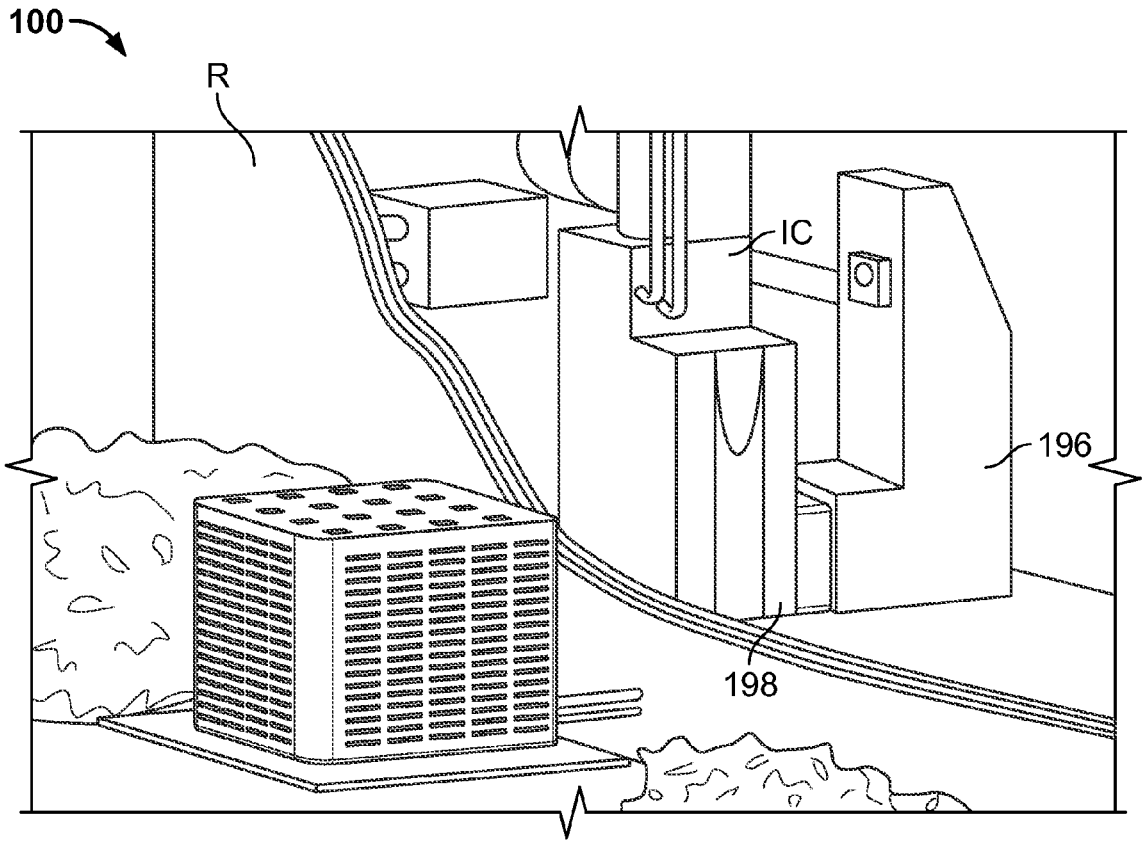
FIG. 1 is an illustration of an exemplary HVAC system disposed in a residential setting.
Figure 2:
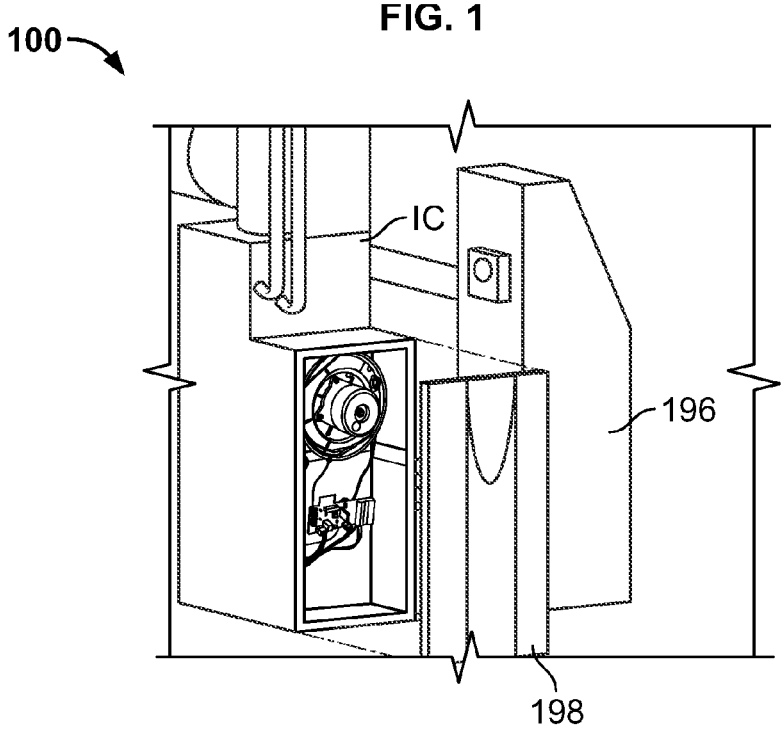
FIG. 2 is a partially exploded view of an exemplary HVAC system according to an exemplary embodiment of the disclosure.

FIG. 1 shows an exemplary HVAC or furnace system 100 in a typical residential setting R. Further, FIG. 2 illustrates an exemplary HVAC or furnace system 100 having a door panel 198. The door panel 198 allows access to the internal portion of the furnace system 100, described in detail below.

Figure 3:
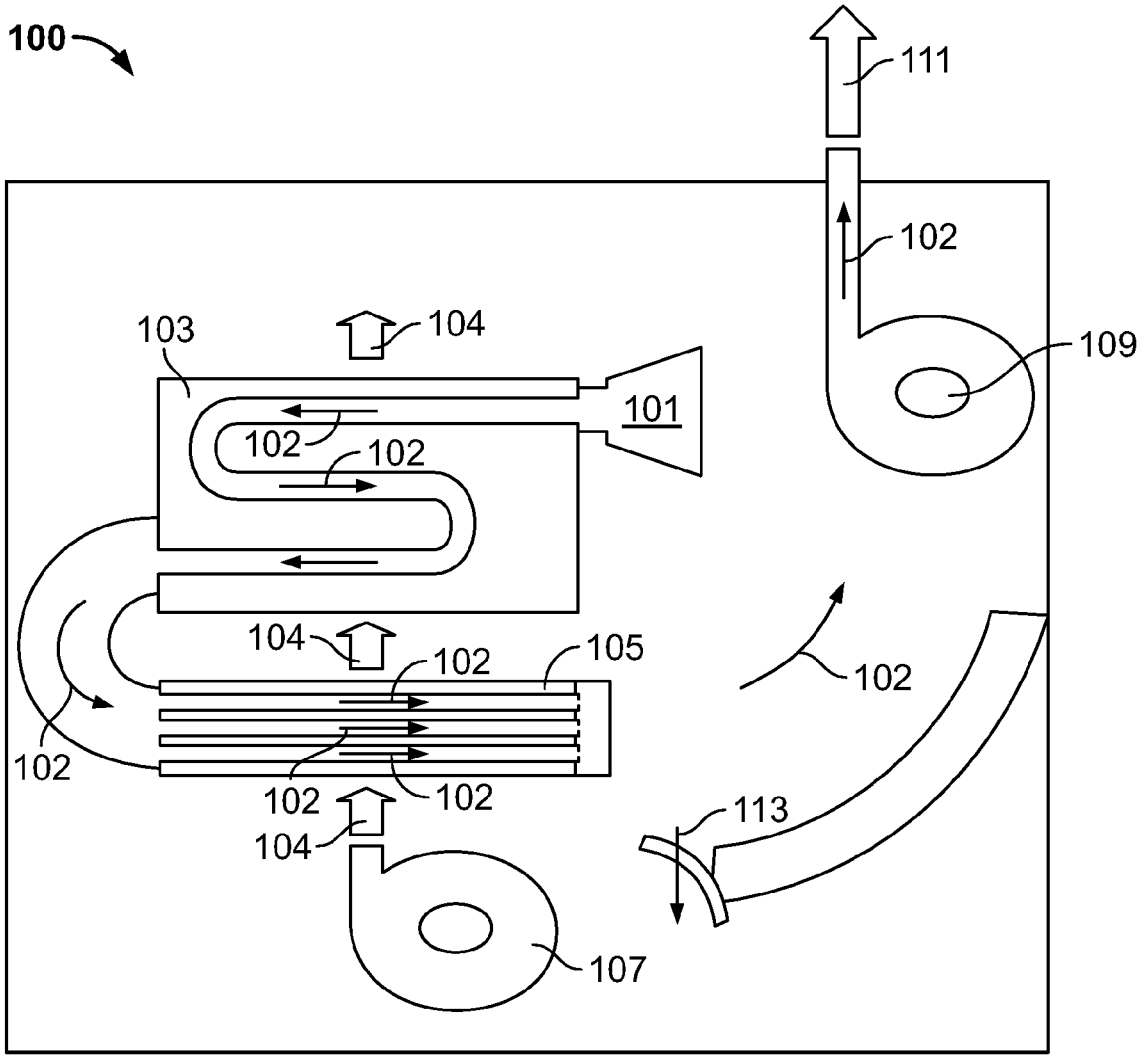
FIG. 3 is a schematic arrangement of a furnace system according to an embodiment of the disclosure.

FIG. 3 shows a schematic arrangement of the internal portion of the furnace system 100. During operation, a burner 101 combusts fuel within combustion air 102 and provides combustion products and heated air to a first heat exchanger 103, where heat is transferred to a supply air 104. Supply air 104 is air that is to be heated, such as interior air for a building HVAC system. Combustion air 102 is then directed into a second heat exchanger 105, where heat is exchanged with supply air 104. Supply air 104 is directed over first heat exchanger 103 and second heat exchanger 105 by use of a blower 107 or similar air-moving device. Combustion air 102 is then exhausted from the system by use of an exhaust blower 109 or other air-moving device. Exhaust 111 includes air, water vapor and other combustion products. Furnace system 100 provides heat to supply air 104 by use of first heat exchanger 103 and second heat exchanger 105. Supply air 104 is than provided to a space for heating.

Figure 4:
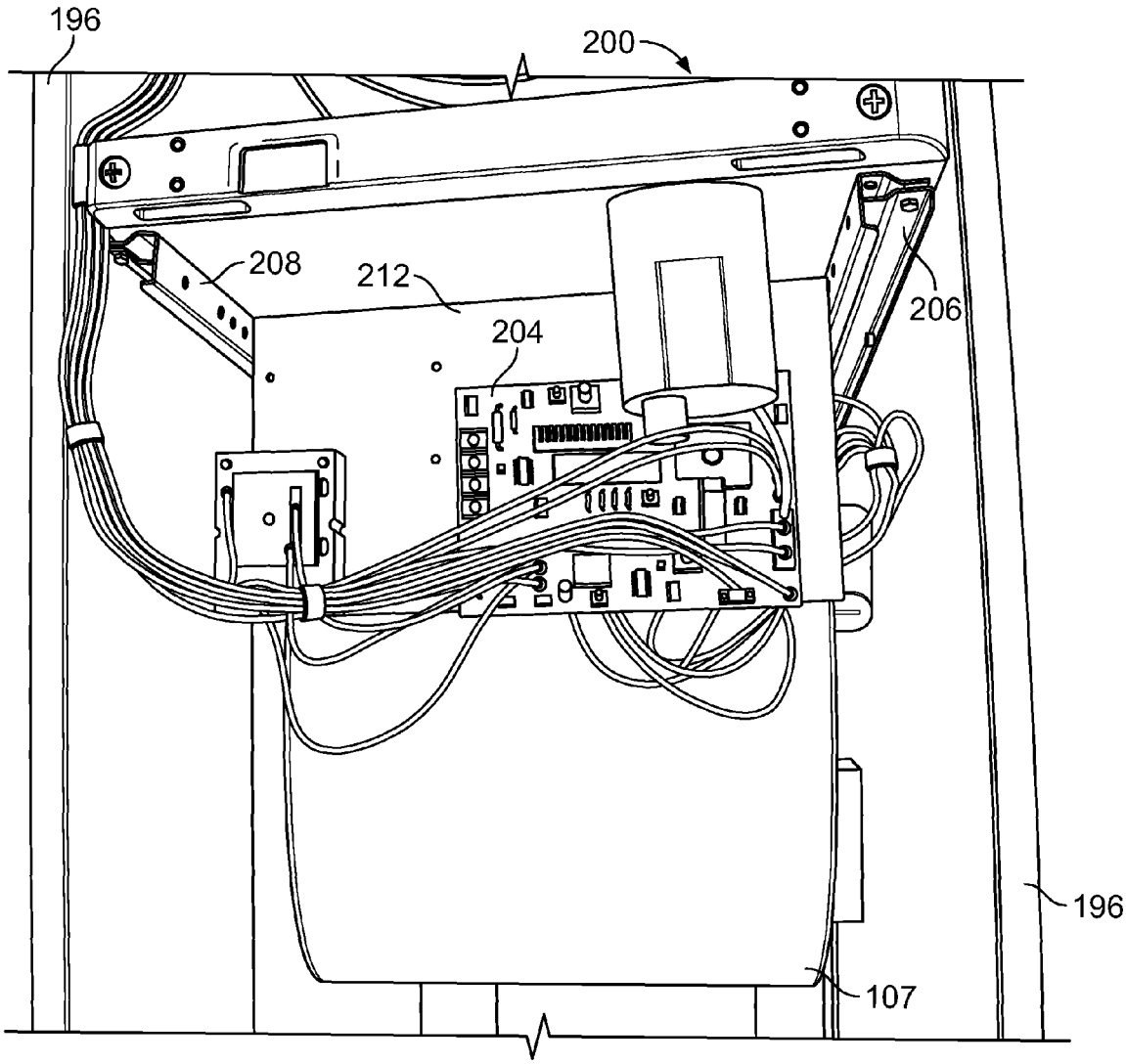
FIG. 4 is an illustration of the blower bracket arrangement with mounted electrical controls.
Figure 5:
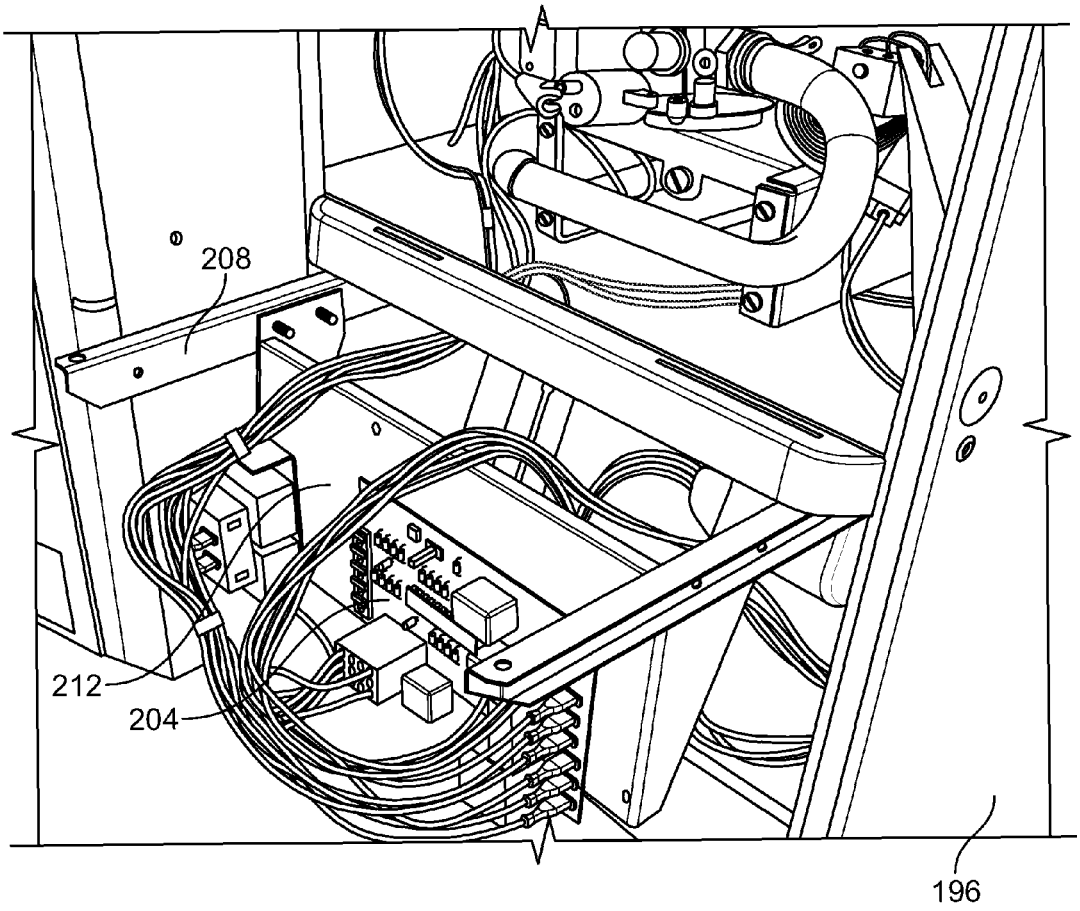
FIG. 5 is a close up illustration of the blower bracket arrangement with mounted electrical controls.

FIGS. 4 and 5 illustrate different views of one embodiment of a blower bracket arrangement 200. The blower bracket arrangement 200 is used to mount to the blower 107 and to provide mounting for electrical components 204. The blower bracket arrangement 200 includes one or more fixed brackets 206 that are mounted to the furnace housing 196 and one or more moveable brackets 208 that are connected to the fixed brackets 206. The moveable brackets 208 are connected to the fixed brackets 206 such that the moveable brackets 208 can move relative to the fixed brackets 206 to permit the blower 107 and the electrical components 204 to slide from the furnace housing 196 for access by a maintenance person or other user. The moveable brackets 208 move relative to the fixed brackets 206 such that the moveable brackets 208 may be either pulled or pushed from the furnace housing 196. In addition, while FIGS. 4 and 5 show the fixed brackets 206 and the moveable brackets 208 being located adjacent the top of the blower 107, it is to be understood that the brackets 206, 208 could also be mounted adjacent the bottom or middle of the blower 107, or on any other suitable location on the blower 107.

Any suitable connection between the fixed brackets 206 and the moveable brackets 208 may be used that will permit relative movement between the two brackets 206, 208, e.g., rollers, fasteners, or grooves. The blower 107 is connected to the moveable brackets 208 such that the blower 107 can be slid from the housing 196 if desired by the maintenance person or user. In addition, a control mounting plate 212 can also be mounted to the moveable brackets 208 such that the control mounting plate 212 can be slid from the furnace housing 196 when the moveable brackets 208 are moved relative to the fixed brackets 206. The control mounting plate 212 can be a metal plate that extends between two moveable brackets 208 and is oriented appropriately for the mounting of electrical components 204. However, it is to be understood that any suitable arrangement for the control mounting plate 212 can be used so long as the control mounting plate 212 can be slid from the furnace housing 196 and provide adequate mounting of electrical components 204.

While the systems and/or methods of the application have been described with reference to several embodiments, it will be understood by those skilled in the art that various changes may be made and equivalents may be substituted for elements thereof without departing from the scope of the application. In addition, many modifications may be made to adapt a particular situation or material to the teachings of the application without departing from the essential scope thereof. Therefore, it is intended that the application not be limited to the particular embodiment disclosed as the best mode contemplated for carrying out the systems and/or methods of the application, but that the application will include all embodiments falling within the scope of the appended claims.

What is claimed is:

1. A bracket arrangement comprising:

at least one fixed bracket, the at least one fixed bracket being substantially stationary;

at least one movable bracket, the at least one movable bracket being movable relative to the at least one fixed bracket and being movable along a path;

a blower, the blower comprising a blower housing being directly mounted to the at least one movable bracket;

a mounting plate with at least one electrical control being mounted to the at least one movable bracket;

the blower housing and mounting plate being separate and distinct components mounted to the at least one movable bracket at separate locations; and upon an application of a force, the blower housing and the mounting plate with at least one electrical control being movable to at least one predetermined position along the path of the at least one movable bracket.

2. The bracket arrangement of claim 1 wherein the at least one fixed bracket is mountable in a housing.

3. The bracket arrangement of claim 2 wherein the at least one predetermined position is a position exterior of the housing.

4. The bracket arrangement of claim 1 wherein the at least one movable bracket comprises two movable brackets.

5. The bracket arrangement of claim 4 wherein the at least one fixed bracket comprises two fixed brackets.

6. The bracket arrangement of claim 4 wherein the mounting plate extends between the two movable brackets.

7. The bracket arrangement of claim 1 wherein the at least one fixed bracket and the at least one movable bracket are connected by and movable about a roller.

8. A system comprising:

a housing, the housing comprising a door panel to provide access to an interior of the housing, the door panel being operable to be repeatedly attached to and detached from the housing;

a first bracket mounted to the housing, the first bracket being substantially stationary;

a second bracket connected to the first bracket, the second bracket being movable relative to the first bracket along a path upon an application of a force to the second bracket, the second bracket being movable from the interior of the housing upon the door panel being detached;

a mounting plate being mounted to the second bracket near the door panel, the mounting plate comprising a surface for the mounting of at least one electrical component;

a blower, the blower being directly mounted to the second bracket at a separate location from the mounting plate, the blower being operable to direct airflow through the housing; and the mounting plate being positioned between the door panel and the blower, the mounting plate and the at least one electrical component being accessible while maintaining the blower within the interior of the housing upon the door panel being detached.

9. The system of claim 8 wherein the second bracket is movable to permit both the mounting plate and blower to be moved from the interior of the housing.

10. The system of claim 8 wherein the second bracket comprises two movable brackets.

11. The system of claim 10 wherein the first bracket comprises two fixed brackets.

12. The system of claim 10 wherein the mounting plate is mounted between the two movable brackets.

13. The system of claim 8 wherein the mounting plate is oriented substantially perpendicular to a direction of travel of the second bracket.

14. The system of claim 13 wherein the at least one electrical component comprises a control board mounted to the mounting plate.

15. The system of claim 8 wherein the first bracket and the second bracket are connected by and movable about a roller.

* * * * *